US005525064A

United States Patent [19]

Mowry

[11] Patent Number: 5,525,064

[45] Date of Patent: Jun. 11, 1996

[54] CONNECTOR WITH MOLDED STUD(S) AND INSULATED NUTS

[75] Inventor: Thomas E. Mowry, Cardiff, Calif.

[73] Assignee: Teledyne Electronic Technologies, San Diego, Calif.

[21] Appl. No.: 375,932

[22] Filed: Jan. 19, 1995

[51] Int. Cl.[6] ..... H01R 9/09; H01R 9/18

[52] U.S. Cl. ..... 439/66; 439/573

[58] Field of Search ..... 439/66, 571, 573, 439/91

[56] References Cited

U.S. PATENT DOCUMENTS

| | | | |
|---|---|---|---|
| 3,215,968 | 12/1960 | Herrmann . | |
| 3,500,285 | 11/1967 | Jones et al. . | |
| 3,551,750 | 12/1970 | Sterling et al. . | |
| 3,673,545 | 6/1972 | Rundle . | |
| 4,057,311 | 11/1977 | Evans . | |
| 4,395,084 | 7/1983 | Conrad . | |
| 4,421,370 | 12/1983 | Treakle et al. | 439/66 |
| 4,508,398 | 4/1985 | Stepan et al. . | |
| 4,636,018 | 1/1987 | Stillie . | |
| 4,699,593 | 10/1987 | Grabbe et al. . | |
| 4,715,820 | 12/1987 | Andrews, Jr. et al. . | |
| 4,738,625 | 4/1988 | Burton et al. . | |
| 4,929,194 | 5/1990 | Korsunsky et al. | 439/571 |
| 5,147,207 | 9/1992 | Mowry . | |
| 5,160,268 | 11/1992 | Hakamian . | |
| 5,228,862 | 7/1993 | Baumberger et al. | 439/66 |
| 5,241,451 | 8/1993 | Walburn et al. | 439/573 |
| 5,266,823 | 7/1993 | Johnson . | |
| 5,473,510 | 12/1995 | Dozier, II | 439/91 |

*Primary Examiner* Stephen P. Garbe
*Attorney, Agent, or Firm* Nydegger & Associates

[57] ABSTRACT

A stackable connector for connecting the conductors of stacked substrates such as printed circuit boards is provided. The connector includes an elongated connector body having a plurality of electrical contacts allowing electrical signals to be passed between the stacked substrates. The connector also includes a plurality of threaded studs and non-conductive nuts allowing the connector body to be securely fastened between the stacked substrates without creating unwanted electrical connections between or within the stacked substrates. The connector also functions as a means for positioning or locating adjacent substrates.

11 Claims, 1 Drawing Sheet

CONNECTOR WITH MOLDED STUD(S) AND INSULATED NUTS

FIELD OF THE INVENTION

The present invention pertains to electrical connectors. More particularly, the present invention pertains to electrical connectors which are useful for providing electrical connection between the individual conductors of stacked substrates such as printed circuit boards. The present invention is particularly, but not exclusively, useful as a stackable connector for printed circuit boards that prevents unwanted electrical contact among the circuit board components.

BACKGROUND OF THE INVENTION

In the electronics industry circuit miniaturization and more compact packaging arrangements have led to the development of different types of connectors for electrically connecting substrates. In general, such connectors may be utilized to provide a detachable electrical connection between adjacent circuit boards. As an example, stacked connectors provide an electrical connection for circuit boards that are stacked relative to one another.

Operationally, a critical aspect of stackable connectors concerns the electrical contact made between the connector and the electrical substrate to which the connector is attached. In greater detail, the connector design must assure that the electrical contact between the connector and the substrate is both correct when established and highly reliable in subsequent use. In practice, however, a number of factors combine to make proper establishment and subsequent reliability of the electrical connection difficult to achieve. These factors include: variations in board thickness, thermal expansion, vibrations associated with various sources, contamination, increasing miniaturization of electronic systems and increasing signal capacities required of connectors.

A second critical aspect of connector design concerns electrical isolation of the electrical components mounted to the substrate. In greater detail, a large number of electrical components may be mounted to a given electrical substrate. Many of these components are themselves conductive to electrical currents. Additionally, the substrate itself often includes a great number of traces each of which is generally conductive to electrical currents. As a result, there is a substantial likelihood of physical contact between either the electrical components mounted on a given substrate or the substrate traces and the electrical connectors used to interconnect adjacent substrates. The likelihood of physical contact increases the chance of unwanted electrical contacts and associated system failures.

To overcome the problems associated with the use of stackable connectors, several connector types have been developed. For instance, one type of stackable connector utilizes a connector body that is placed between adjacent substrates. The substrates are then clamped together holding the connector body in contact with each of the substrates. The chief disadvantage associated with this connector type is the need for a separate clamping mechanism and the resulting need that the clamping mechanism be specially configured to provide the tolerances required to maintain proper contact between the connector and the respective substrates.

Another connector type positions a connector body between two substrates and then attaches each substrate to the connector body. This connector type functions as both an electrical connector and a means of physically attaching and positioning adjacent substrates. Connectors of this type typically provide screws or bolts which pass through the substrate and attach the connector. U.S. Pat. No. 4,057,311 which issued to Evans for an invention entitled "Elastomeric Connector for Parallel Circuit Boards" and U.S. Pat. No. 3,551,750 which issued to Sterling for an invention entitled "Circuit Board Connector" disclose prior art connectors which function both as electrical connectors and a means of physically attaching and positioning adjacent substrates.

The Evans and Sterling inventions, however, included several impediments. Specifically, both inventions relied on the use of separate clamping bolts passing through the connector and the adjacent substrates. These bolts, if conductive, require that electrical components or board traces be eliminated from the areas in which the bolts make contact with the substrates. Additionally, the bolts are separate pieces making the bolt and connector assembly more costly to manufacture and install and increasing the likelihood of defects introduced at assembly time. Finally, the bolts require the use of specialized tools as the substrates are assembled further increasing the cost and difficulty associated with the use of these connectors.

The present invention recognizes the need for an inexpensive single-piece stackable connector for adjacent circuit boards. Furthermore, the present invention recognizes the need for a connector with associated mounting hardware that is non-conductive and does not interfere with electrical traces present in printed circuit boards.

In light of the above, it is an object of the present invention to provide a low-cost stackable connector for adjacent circuit boards that features single-piece construction. It is yet another object of the present invention to provide a low-cost stackable connector for adjacent circuit boards that will not interfere with electrical traces present in printed circuit boards and may be assembled by hand without the need for specialized tools. Still another object of the present invention is to provide a low-cost stackable connector for adjacent circuit boards which is simple to use, relatively easy to manufacture, and comparatively cost effective.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF PREFERRED EMBODIMENTS

Figure 1:
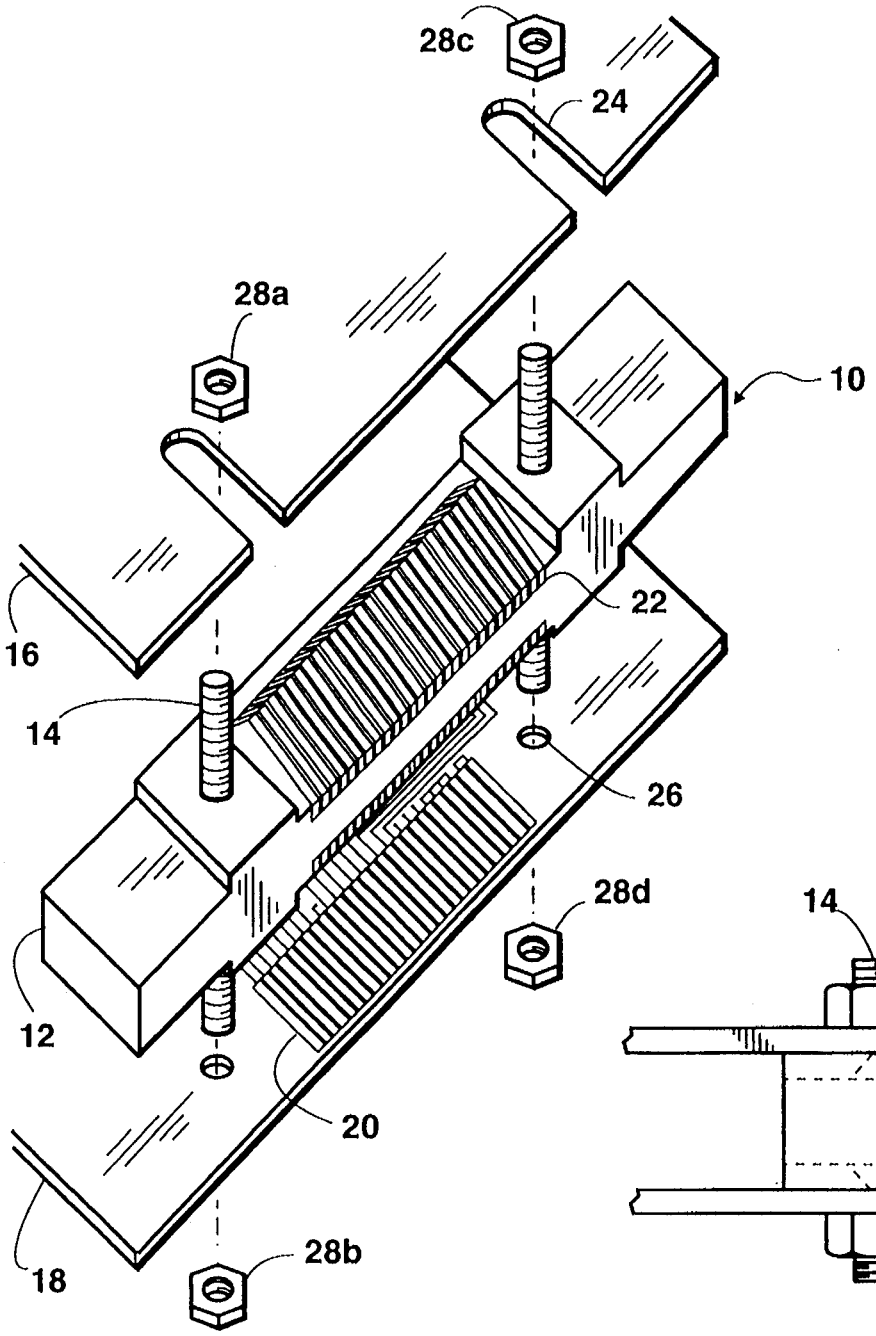
FIG. 1 is an exploded isometric view of the connector of the present invention positioned between two circuit boards.

Referring initially to FIG. 1, it can be seen that the stackable connector of the present invention is shown and generally designated 10. The stackable connector 10 includes a connector body 12 and at least one threaded stud 14. Preferably, the connector body 12 and the threaded studs 14 are molded as a single piece of plastic. It may be appreciated that the connector body 12, shown in FIG. 1 may be manufactured in various lengths allowing the stackable connector 10 to be used in combination with circuit boards or other substrates of various sizes. In cases where a longer stackable connector 10 is required, it may be appreciated that the connector body 12 may be increased in length and additional studs 14 added.

Operationally, the stackable connector 10 is placed between an upper substrate 16, and a lower substrate 18. It can be seen that the lower substrate 18 includes a series of substrate contacts 20. The substrate contacts 20 are designed to physically connect to the connector contacts 22 included in the stackable connector 10 when the upper substrate 16 and the lower substrate 18 are connected with the stackable connector 10. The physical connection between the substrate contacts 20 and the connector contacts 22 establishes an electrical signal pathway between the upper substrate 16 and the lower substrate 18.

Figure 2:
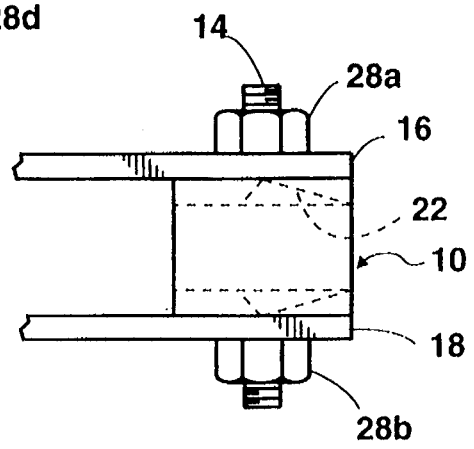
FIG. 2 is a side elevational view of the connector of the present invention operationally positioned between two circuit boards with the connector contacts shown in phantom for clarity.

It may be appreciated that many different types of connector contacts 22 are useful for the present invention. For instance, FIGS. 1 and 2 show a type of flexible spring contact, however, other contact types, such as coil spring contacts, are equally practical.

Figure 3:
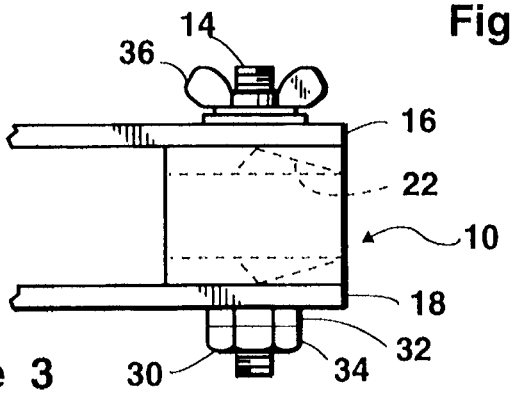
FIG. 3 is a side elevational view of the connector of the present invention operationally positioned between two circuit boards, with the connector contacts shown in phantom, and an alternate embodiment shown for the fasteners.

In addition to providing a path for intersubstrate electrical signals, the stackable connector 10 performs a second major function, namely it provides positive support and location for the upper substrate 16 and the lower substrate 18. In more detail, it can be seen in FIGS. 1 and 2 that the threaded studs 14 and non-conductive nuts 28 and 28*b* securely lock upper substrate 16 and lower substrate 18 in position adjacent to stackable connector 10. In particular, it can be seen that upper substrate 16 includes slots designated 24 designed to accept the passage of threaded studs 14. Alternatively, lower substrate 18 includes holes 26 designed to perform the same function. For purposes of the present invention, slots 24 or holes 26 can be used on either upper substrate 16 or lower substrate 18, as desired by the user. It may be appreciated that both the threaded studs 14 and the non-conductive nuts 28 are formed from molded plastic reducing the cost of stackable connector 10 as well as preventing inadvertent electrical contact between the threaded studs 14 and non-conductive nuts 28 and the upper substrate 14 or the lower substrate 16. Alternatively, as shown in FIG. 3, insulated nuts 30 may be used. The insulated nuts 30, include an insulated base 32 and a metal upper section 34. In comparison with the non-conductive nuts 28 shown in FIG. 2, the insulated nuts 30 offer increased strength.

In another alternative for the fasteners of the present invention, as shown in FIG. 3, the upper substrate 16 and the lower substrate 18 may be retained by use of finger nuts 36. Fasteners of this type offer increased ease of assembly albeit at some loss of overall strength. FIG. 3 shows the use of a finger nut 36 to retain the upper substrate 16. The finger nuts 36 may also be replaced with captive nuts of a type well known in the pertinent art. The use of captive nuts (not shown) prevents the nuts from being removed from the threaded studs 14 and thereby prevents the loss of the captive nuts.

In yet another alternative embodiment of the present invention, the stackable connector 10 may be fitted with an alternative mounting means for one of the substrates. For instance, the threaded studs 14 and non-conductive nuts 28 used to retain the lower substrate 18 as shown in FIGS. 1 and 2 may be replaced with a system whereby the stackable connector 10 is soldered to the lower substrate 18 while still retaining the threaded studs 14 and non-conductive nuts 28 used to retain the upper substrate 16. In general, the use of a solder type mount may be accomplished by replacing the connector contacts 22 with solder type contacts designed to be inserted into holes included in the lower substrate 18 and retained by application of molten solder.

While the particular device as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

I claim:

1. An electrical connector for connecting a first substrate having electrical contacts with a second substrate having electrical contacts, including:

an elongated insulator block having a first side and a second side;

contact means for establishing a plurality of electrical signal paths between said first side and said second side of said insulator block;

a plurality of threaded studs extending from said first side of said insulator block;

a plurality of threaded studs extending from said second side of said insulator block;

a first plurality of insulated nuts, each said nut threadably engagable with a respective stud extending from said first side to hold said first substrate against said first side of said insulator block to establish electrical communication between said electrical contacts on said first substrate and said contact means; and a second plurality of insulated nuts, each said nut threadably engagable with a respective stud extending from said second side to hold said second substrate against said second side of said insulator block to establish electrical communication between said electrical contacts on said second substrate and said contact means.

2. A connector as recited in claim 1 wherein the means for establishing electrical signal paths further comprises a plurality of spring contacts mounted to said insulator block, each said spring contact having a first contact end extending from said first side of said insulator block and a second contact end extending from said second side of said insulator block.

3. A connector as recited in claim 1 wherein said insulator block is integrally connected with each said threaded stud.

4. A connector as recited in claim 1 wherein said insulated nuts are formed as finger nuts.

5. A connector as recited in claim 1 wherein said insulated nuts are captive nuts.

6. An electrical connector for connecting a first substrate having electrical contacts with a second substrate having electrical contacts, which comprises:

an elongated insulator block having a first side and a second side;

contact means for establishing a plurality of electrical signal paths between said first side and said second side of said insulator block;

means for mounting said second side of said insulator block to said second substrate to establish electrical communication between said electrical contacts of said second substrate and said contact means;

a plurality of threaded studs extending from said second side; and a plurality of insulated nuts, each said nut threadably engagable with a respective stud to hold said first substrate between said stud and said first side of said insulator block to establish electrical communication between said electrical contacts of said second substrate and said contact means.

7. A connector as recited in claim 6 wherein said means for establishing electrical signal paths further comprises a plurality of spring contacts mounted to said insulator block, each said spring contact having a first contact end extending from said first side of said insulator block.

8. A connector as recited in claim 6 wherein the means for mounting said second side to said second substrate includes soldering said first side to said first substrate.

9. A connector as recited in claim 1 wherein said insulator block is integrally connected with each said threaded stud.

10. A connector as recited in claim 6 wherein said insulated nuts are formed as finger nuts.

11. A connector as recited in claim 6 wherein said insulated nuts are captive nuts.

* * * * *